United States Patent [19]

Larsen

[11] Patent Number: 4,466,371

[45] Date of Patent: Aug. 21, 1984

[54] THREADING ARRANGEMENT FOR A SEWING MACHINE

[75] Inventor: Robert H. Larsen, Middletown, N.J.

[73] Assignee: The Singer Company, Stamford, Conn.

[21] Appl. No.: 512,850

[22] Filed: Jul. 11, 1983

[51] Int. Cl.[3] ..... D05B 47/00

[52] U.S. Cl. ..... 112/302; 112/254

[58] Field of Search ..... 112/254, 302

[56] References Cited

U.S. PATENT DOCUMENTS 3,782,312 1/1974 Kasuga .
3,789,784 2/1974 Hanyu et al. .
4,030,431 6/1977 Martin et al. .
4,161,152 7/1979 Herron .
4,183,313 1/1980 Odermann et al. ..... 112/302
4,241,678 12/1980 Tullman .
4,248,169 2/1981 Giaimo et al. .
4,296,701 10/1981 Larsen ..... 112/302

*Primary Examiner*—Werner H. Schroeder
*Assistant Examiner*—Andrew M. Falik
*Attorney, Agent, or Firm*—William V. Ebs; Robert E. Smith; Edward L. Bell

[57] ABSTRACT

A thread tensioning module and a cover for a thread holder and cooperating take-up are mounted adjacent to one another in a front opening in the bracket arm housing of a sewing machine. The module and cover form interconnecting thread receiving slots in the bracket arm opening providing for the movement of thread into thread tensioning mechanism carried by the module and into the thread holder as the machine is threaded by an operator.

5 Claims, 6 Drawing Figures

THREADING ARRANGEMENT FOR A SEWING MACHINE

DESCRIPTION

BACKGROUND OF THE INVENTION

1. Field of the Invention

The invention is directed to a threading arrangement for a sewing machine.

2. Description of the Prior Art

A sewing machine operator must pass thread through tensioning mechanism and a take-up before sewing operations can be satisfactorily performed. The threading of such sewing instrumentalities can be a tedious task, and if not properly performed leads to defective stitches. Various arrangements have been developed to simplify the threading of a machine, however, they have generally complicated the construction of a machine to a prohibitive extent or have proved to be unreliable in use.

It is a prime object of the present invention to provide a sewing machine with an improved threading arrangement effective to reliably assure the proper threading of sewing instrumentalities on the machine, and effective by its appearance to make the manner of its use readily apparent to a machine operator.

It is another object of the invention to provide a sewing machine with a simplified bracket arm assembly effective to define a self-evident path for sewing thread on the machine, and to assure the movement of thread into both thread tensioning mechanism and a thread handling device.

Other objects and advantages of the invention will become apparent during a reading of the specification taken in connection with the accompanying drawings.

SUMMARY OF THE INVENTION

The bracket arm housing of a sewing machine is provided with a front opening. A thread tensioning module and a cover for a thread holder and cooperating take-up are secured to the bracket arm in such opening. Both the module and cover have parallel opposite sides. One side of the module forms a first thread receiving vertical slot with the bracket arm housing, and the other side of the module forms another vertical thread receiving slot with one side of the cover. The other side of the cover forms still another vertical thread receiving slot with the bracket arm housing. A bottom end portion of the thread tensioning module and the bracket arm housing for a slot interconnecting lower ends of the said first and another thread receiving slot. The cover and a top portion of the bracket arm housing form a slot interconnecting the said another and still another thread receiving slots. The slot at the top of the bracket arm is disposed relative to the thread holder to provide for the movement of thread through such slot into the holder. Thread tensioning mechanism on the module projects into the said first slot to catch thread led therein and around the lower end of the module.

DESCRIPTION OF THE PREFERRED EMBODIMENT

Figure 1:
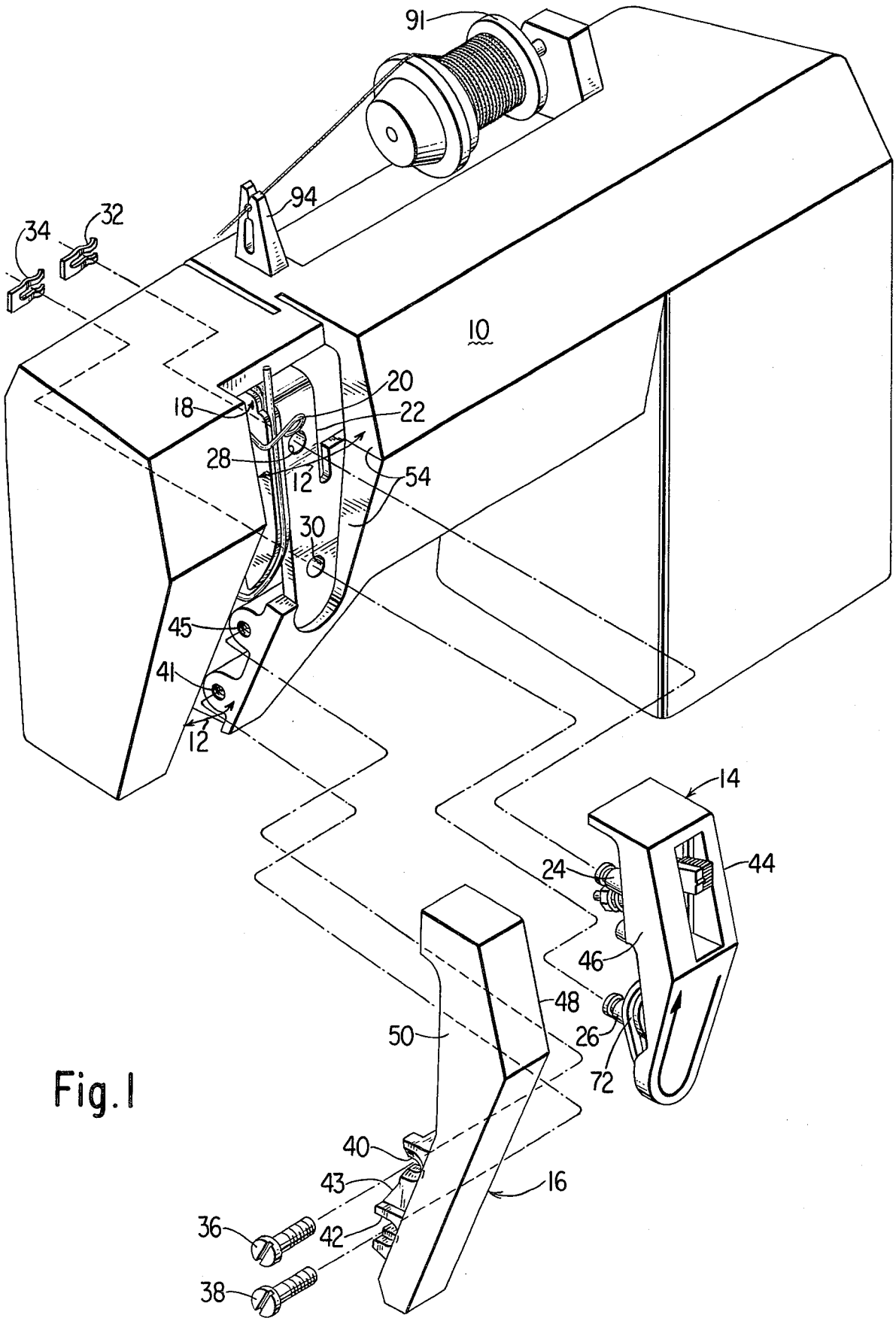
FIG. 1 is an exploded perspective view showing a bracket arm of a sewing machine along with a cover and thread tensioning module which attach thereto to provide a threading according to the invention.
Figure 2:
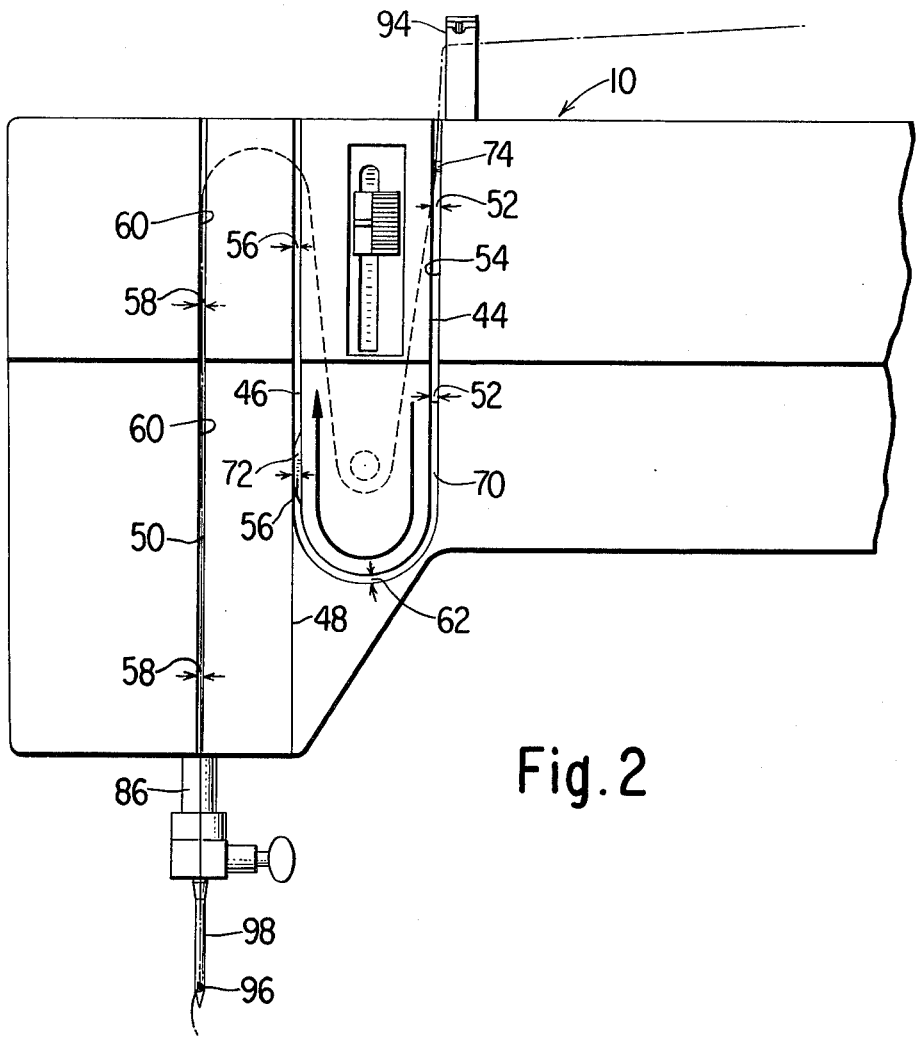
FIGS. 2 and 3 are fragmentary front and side views respectively showing the bracket arm with the cover and thread tensioning module thereon.
Figure 3:
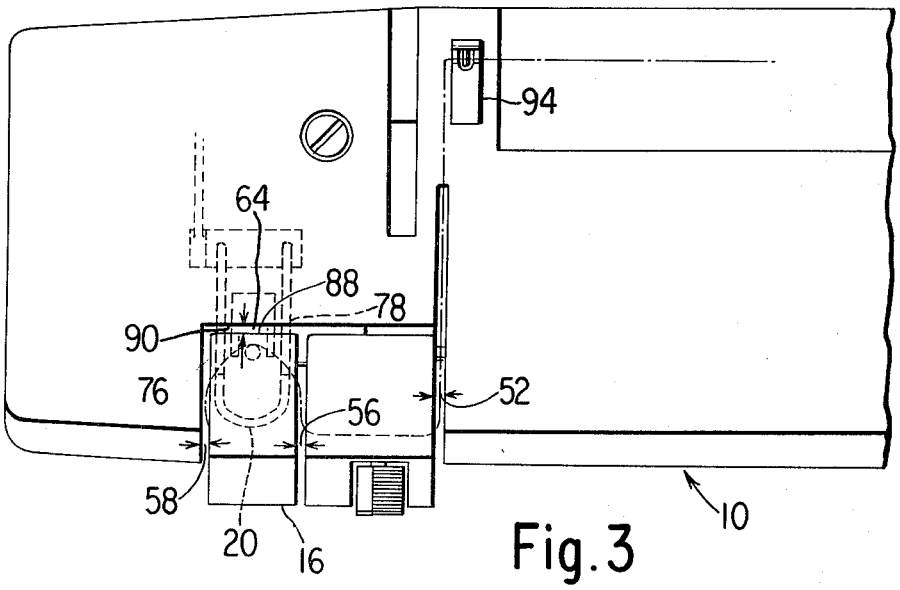
Figure 4:
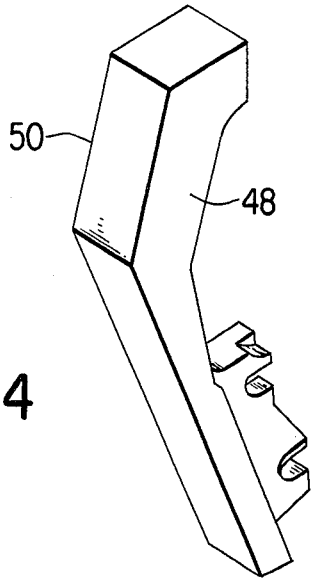
FIG. 4 is a right side perspective view of the cover.
Figure 5:
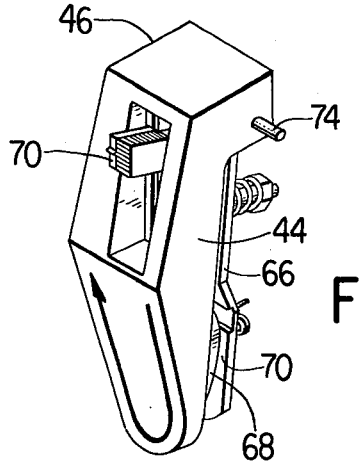
FIG. 5 is a right side perspective view of the thread tensioning module.
Figure 6:
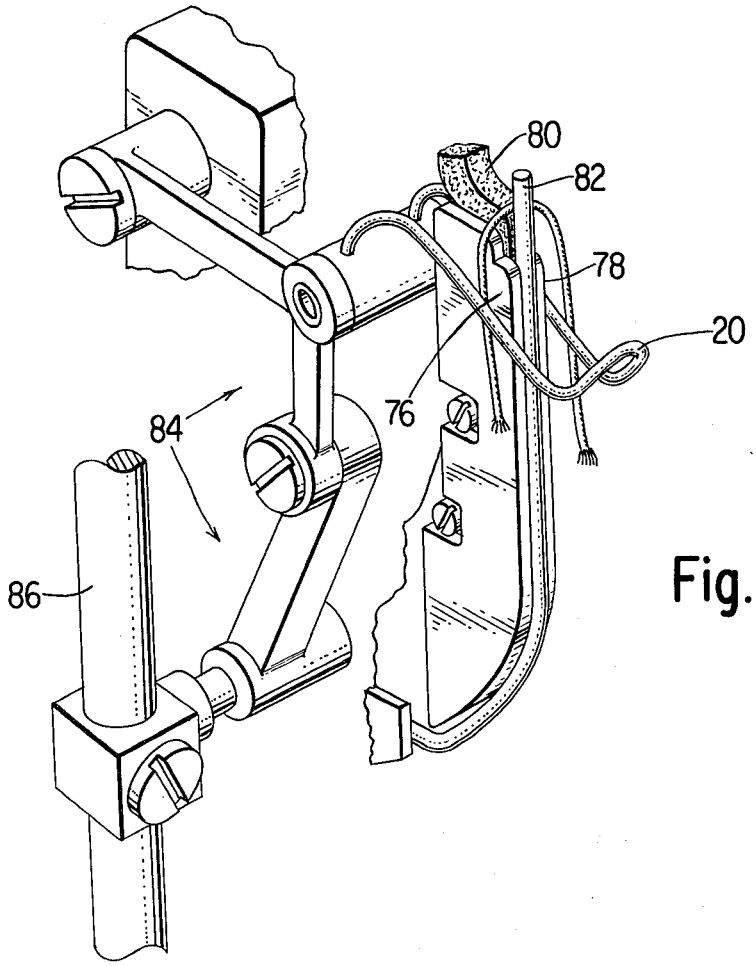
FIG. 6 is a perspective view showing a thread holder and cooperating take-up as provided in the bracket arm of FIGS. 1, 2 and 3.

Referring to the drawings, reference character 10 designates the bracket arm housing of a sewing machine. The housing is formed with an opening 12 which is adapted to receive a thread tensioning module 14, and a hollow cover 16 for a thread holder 18 and cooperating take-up 20. The bracket arm housing includes as an integral part thereof, a support 22 for module 14.

Module 14 has posts 24 and 26 which project from the rear and are insertable through holes 28 and 30, respectively, in support 22. The module is disposed in opening 12 with posts 24 and 26 projecting through the said openings, and spring fastener 32 and 34 are applied to the posts to affix the position of the module in the bracket arm housing. Cover 16 is secured to the bracket housing in opening 12 with screws 36 and 38 extending through slotted openings 40 and 42, respectively, in a flanged portion 43 of the cover and into threaded holes 41 and 45 of the bracket housing.

In the secured positions in opening 12 of the module 14 and cover 16, such parts form in association with each other, and with the bracket arm housing 10 a self-evident threading path for thread to be used in sewing operations. As shown, the module 14 has parallel opposite sides 44 and 46, and the cover has parallel opposite sides 48 and 50. One side 44 of the module forms a vertical slot 52 in the bracket arm housing 10 with an end wall 54 of the housing, and the other side 46 forms a vertical slot 56 with side 48 of the cover. Side 50 of the cover forms a vertical slot 58 with an end wall 60 of housing 10. The lower ends of slots 52 and 56 are interconnected by way of a curvilinear slot 62 extending around the lower end of the module between the module and the bracket arm housing. Slots 56 and 58 are interconnected by a cross over slot 64 which is formed at the top of the bracket arm between cover 16 and the bracket arm housing.

Module 14 is of the kind disclosed in the copending patent application of A. Giamo and R. H. Larsen for "Thread Tensioning Module for a Sewing Machine", Ser. No. 512,849, filed July 11, 1983. As such, the module includes thread tensioning mechanism with thread engageable parts 66 and 68 for applying tension to thread according to the position of a control knob 70. Thread engageable post 66 includes a marginal edge portion 70 which projects beyond side 44 of module 14, and which in the secured position of the module in bracket arm housing 10 extends across slot 52. Part 66 also includes a marginal edge portion 72 which projects beyond side 46 of the module to extend across slot 56. Module 14 is provided at side 44 with an affixed thread guiding pin 74 to extend across slot 52 near the top of the bracket arm housing.

Cross-over slot 64 lies directly over thread holder 18, such thread holder being of the kind disclosed in the copending patent application of Donald Rodda for "Camming Arrangement for Thread Handling Device", Ser. No. 422,770, U.S. Pat. No. 4,413,578 filed Sept. 24, 1982. The thread holder includes thread engageable cams 76 and 78 which bracket an elongate fibrous member 80 and bar 82 engaged thereby. Take-up 20 brackets the thread holder and is movable therealong by mechanism 84 which is connected to needle bar 86. The front edge 88 of slot 64 is rearward of bar 82 and the rear edge 90 of the slot is directly over cams 76 and 78.

A machine with bracket arm housing 10, module 14 and cover 16 assembled as described is threaded with thread T from a supply spool 91 by first having the thread pass through a guide 94 and then into slot 52. The thread is then led down vertical slot 52, through curvilinear slot 62 extending around the lower end of module 14, up vertical slot 56, through cross-over slot 64, down vertical slot 58 and then through the eye 96 of a sewing needle 98. The thread is engaged by pin 74 in slot 52 and is caught in the lower end portion of the slot by marginal edge portion 70 of part 66 of the thread tensioning mechanism in module 14. As the thread is led about the module and up slot 56 the thread slides on part 66 into a position between the thread tensioning parts 66 and 68. After the thread has been disposed into cross-over slot 64 and while being moved down slot 58, the thread is caused to engage thread holder 18 rearwardly by the bar 82 and to slide into a position on cams 76 and 78, and between the fibrous member 80 and bar 82.

It is to be understood that the present disclosure relates to a preferred embodiment of the invention which is for purposes of illustration only and is not to be construed as a limitation of the invention. Numerous alterations and modifications of the structure herein will suggest themselves to those skilled in the art, and all such modifications and alterations which do not depart from the spirit and scope of the invention are intended to be included within the scope of the appended claims.

I claim:

1. In a sewing machine, a bracket arm housing with a front opening, a thread tensioning module in said opening, a cover for a thread holder and cooperating take-up also in said opening, the module having parallel opposite sides, and said cover having parallel opposite sides, one of the module sides forming a first thread receiving vertical slot with the bracket arm housing and the other module side forming another vertical thread receiving slot with one of the sides of the cover, the other side of the cover forming still another vertical thread receiving slot with the bracket arm housing, said module forming a slot with the bracket arm housing interconnecting lower ends of the said first and another thread receiving slot, and said cover forming a slot with the bracket arm housing at the top of the bracket arm interconnecting the said another and still another thread receiving slots, the slot at the top of the bracket arm being disposed relative to the thread holder to provide for the movement of thread through such slot into the holder.

2. The combination of claim 1 wherein the module includes thread tensioning mechanism which projects into said first slot to catch thread led therein and around the lower end of the module.

3. The combination of claim 1 including a thread guiding pin disposed to extend across said first slot.

4. The combination of claim 3 wherein the pin is affixed in the module.

5. The combination of claim 1 wherein the slot interconnecting the lower ends of said first and another thread receiving slot is curvilinear.

* * * * *